US005578177A

United States Patent [19]

Wolf

[11] Patent Number: 5,578,177

[45] Date of Patent: Nov. 26, 1996

[54] METHOD OF MANUFACTURING FULLY ANNEALED METAL ANODES

[75] Inventor: Gary A. Wolf, Long Valley, N.J.

[73] Assignee: RFE Industries, Inc., Keasbey, N.J.

[21] Appl. No.: 546,621

[22] Filed: Oct. 23, 1995

Related U.S. Application Data

[63] Continuation of Ser. No. 190,782, Feb. 1, 1994, abandoned.

[51] Int. Cl.[6] ..... C25B 11/04

[52] U.S. Cl. ..... 204/292; 148/538; 148/678; 164/47; 164/66.1; 164/68.1; 164/125; 164/126; 164/128; 420/501; 29/623.1; 29/33 C; 29/DIG. 5

[58] Field of Search ..... 204/292; 148/538, 148/678; 164/47, 66.1, 68.1, 125, 126, 128; 420/501; 29/623.1, 33 C, DIG. 5

[56] References Cited

U.S. PATENT DOCUMENTS 3,331,709 7/1967 Hill et al. ..... 204/292
4,162,700 7/1979 Kahn ..... 164/126

FOREIGN PATENT DOCUMENTS 8087235 5/1983 Japan .

*Primary Examiner*—Bruce F. Bell
*Attorney, Agent, or Firm*—Arthur Jacob

[57] ABSTRACT

Methods of manufacturing fully annealed metal anodes are disclosed. The methods contemplate supplying metal and heating the metal until it has obtained a molten state. The molten metal is permitted to flow into a die and transported therethrough where it is cooled until it solidifies. The flow rate of the metal through the die and the extent of cooling are selected such that a fully annealed metal anode is obtained.

26 Claims, 5 Drawing Sheets

METHOD OF MANUFACTURING FULLY ANNEALED METAL ANODES

This application is a continuation, of application Ser. No. 08/190,782 filed Feb. 1, 1994now abandoned.

FIELD OF THE INVENTION

The present invention relates in general to methods of manufacturing metal anodes and more particularly, to methods of manufacturing fully annealed silver anodes by continuous casting for use in direct electroplating.

BACKGROUND OF THE INVENTION

Silver is a desirable metal for use in various industries such as electrolytic anodes in the electroplating industry. In use, electrolytic silver anodes are placed in a plating bath with an object to be plated by electrodeposition of the silver anode. Various problems associated with silver anodes have plagued the prior art. One particular problem is caused by the inherent chemical composition of silver which reacts readily with ambient oxygen to form oxides when exposed to a sufficient amount of heat. Thus, silver oxide will form in this manner in accordance with the following equation: $Ag + 0_2 + heat \rightarrow Ag_2\mathbf{0}$. Since silver anodes are manufactured from molten silver, the molten silver absorbs oxygen during the manufacturing process resulting in the inclusion of undesirable oxides. Silver anodes including such oxides result in sludge being deposited in the plating bath. It also renders the electroplating process inefficient as the silver anode will be prevented from readily dissolving. Thus, the electroplating process is hampered by silver anodes which include silver oxide, even in small levels.

Another problem which arises with silver anodes is caused by impurities in the anodes, such as iron and sulfur, and the existence of insoluble particulate silver. When silver anodes including such impurities and insoluble particles are used, the electroplating process is hampered by unacceptable particles being deposited on the plated object.

Known processes for manufacturing silver anodes result in uniform crystal formation and large flat grains. In use, these silver anodes do not dissolve uniformly during the electrodeposition process. Instead, these silver anodes will dissolve along their grain boundaries so that the silver will flake and accumulate at the bottom of the plating tank.

Prior art inventors have attempted to solve some of the foregoing problems. However, no known prior art method of manufacturing silver anodes discloses a suitable efficient solution for the foregoing problems. U.S. Pat. No. 2,802,782 to Bayes et al. discloses an electroplating apparatus and a silver anode for use therewith. The silver anode may be manufactured by an extrusion process. U.S. Pat. No. 3,331,709 to Hill et al. discloses a method of producing silver anodes by removing oxygen from the silver. The method disclosed in the Hill et al. patent is particularly tedious and inefficient as it requires the initial manufacture of a silver billet, and subsequently reheating the silver billet in an annealing furnace.

The present invention solves all of the aforementioned problems by providing an efficient method of manufacturing fully annealed silver anodes.

SUMMARY OF THE INVENTION

One method of manufacturing metal anodes having a fully annealed state in accordance with the present invention initially comprises the step of supplying metal which will be used to form the anode. The metal is heated until it has obtained a molten state. The molten metal is then caused to flow at a predetermined flow rate through a channel provided between an inlet and an outlet of a die having a predetermined length. The molten metal is cooled as it flows through the channel so that it obtains a substantially solid state therein. The predetermined flow rate and cooling of the molten metal are selected so that the resulting metal anode has a fully annealed state upon exiting the die.

In a particularly preferred embodiment, the step of cooling the molten metal comprises initiating cooling within a predetermined cooling zone wherein the cooling zone extends over less than about 50% of the predetermined length of the die. It is also preferable that the die include a first half extending from the inlet and a second half extending from the outlet wherein the cooling zone is arranged only within the vicinity of the second half of the die. Cooling of the molten metal may be accomplished by various means. In one embodiment the step of cooling the molten metal comprises flowing cooling fluid through a plurality of cooling plates arranged adjacent the die.

It is preferable for the supply of metal to comprise at least 99.9% silver. In an even more preferable embodiment, the metal comprises at least 99.995% silver. Although the temperature of the silver in the molten state may vary, in one embodiment the temperature may be in the range of between about 1900° F. and 2300° F. In another embodiment, the molten state of the silver may be in the range of about 2050° F. to 2250° F.

The fully annealed metal anode manufactured in accordance with the method of the present invention is formed as the solidified metal exits the outlet of the die. In one embodiment, the flow rate of the metal through the channel of the die is between about two inches per minute and ten inches per minute. More particularly, the flow rate of the metal through the channel may be between about four inches per minute and six inches per minute.

The horizontal and vertical axes of the outlet are each at least about 0.0001 inch longer than the horizontal and vertical axes of the inlet. This size differential accommodates the expansion of the cross-sectional area of the metal during cooling as it flows between the inlet and the outlet of the channel.

Preferably, the predetermined flow rate and cooling are selected such that the solidified anode at the outlet of the die is in the range of about 300° F. to 425° F.

The method of the present invention may be advantageously performed if the step of heating the metal to a molten state occurs within a crucible. It is also desirable for the method to comprise the step of purging the molten metal within the crucible with an inert gas, such as nitrogen, which flows through the molten metal from a lower portion of the crucible to an upper portion thereof.

Although the length of the die used to perform the method of the present invention may vary, in one embodiment, the predetermined length of the die is between about ten and twenty-four inches. In another embodiment, the predetermined length of the die is between about twelve and seventeen inches.

According to another aspect of the present invention, a fully annealed metal anode is manufactured by a method, such as the method described above. Metal anodes produced in accordance with such method have many advantages over prior art anodes including far superior performance during use and the elimination of problems which have plagued the prior art.

Accordingly, it is an object of the present invention to provide a method of manufacturing fully annealed silver anodes which will yield consistently high quality silver that will efficiently transmit silver ions within a plating bath so that electroplating of a desired object can be optimally performed.

It is another object of the present invention to provide fully annealed silver anodes for use in electroplating procedures to overcome prior art problems that have previously been associated with the electrodeposition of silver.

The above description, as well as further objects, features and advantages of the present invention will be more fully understood when taken in conjunction with the following detailed description of the methods of the present invention and the accompanying drawings.

DETAILED DESCRIPTION OF THE PREFERRED EMBODIMENTS

In accordance with the present invention, it is desirable to manufacture a fully annealed metal anode which can be used for electroplating. The use of silver anodes for electroplating is desirable for many applications. In the use of silver plating, it is preferable for at least 99.9% of the metal anode to comprise silver. However, it should be understood that small amounts of various impurities may exist in the anodes of the present invention and that other metals can be used other than silver, depending on the desired use of the anodes in electroplating applications.

Silver anodes typically must have a particularly high degree of purity. In this regard, anodes manufactured in accordance with the method of the present invention typically include about 99.995% silver. The remainder of the anode may comprise about 0.001% Cu, and less than 0.001% of Sb, Sn, As, Fe and Ni. The anodes manufactured in accordance with the method of the present invention as described hereinafter are considered "silver" anodes and are marketed by RFE Industries under the trademark OXY FREE.

The high purity silver anodes of the present invention effectively eliminate many of the problems that have plagued the electroplating art. In particular, some of the problems which have been overcome include accumulation of sludge in the plating tank, flaking of the silver anode where large particles accumulate at the bottom of the plating tank, formation of silver oxide which prevents proper dissolution of silver from the anode, and other problems which take place during the electroplating procedure within the plating tank.

In order to fully appreciate the present method of manufacturing fully annealed silver anodes, a basic understanding of one apparatus for carrying out the method steps would be helpful. Accordingly, a brief discussion of one such apparatus now follows and will precede a discussion of the specific steps of the present method.

Figure 1:
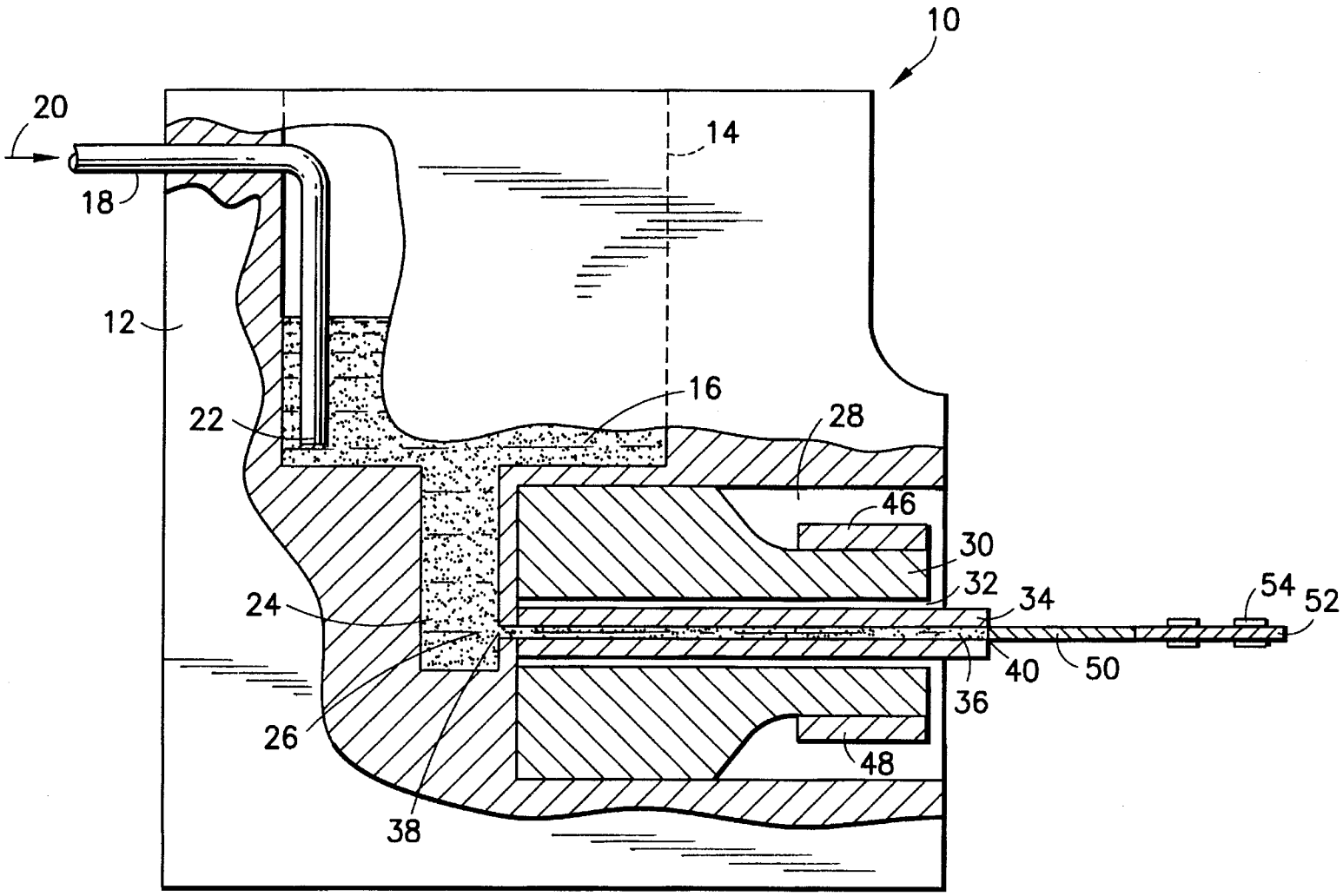
FIG. 1 is a partial cross-sectional view of an apparatus which may be used to carry out the method of the present invention.

FIG. 1 illustrates an apparatus which may be utilized to perform the method of manufacturing fully annealed silver anodes in accordance with the present invention. The apparatus is generally designated by reference numeral 10 and includes a crucible generally designated 12. The crucible 12 has an upper cavity 14 which is designed to retain silver 16 therein as it is heated to its molten state by a heating device (not shown). The molten silver 16 preferably has a purity level of at least about 99.995% as discussed above.

Figure 3:
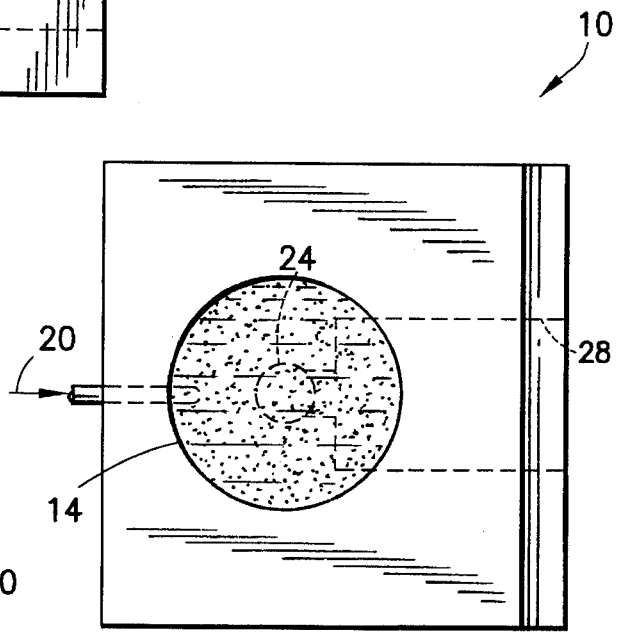
FIG. 3 is a top plan view of the portion of the apparatus shown in FIG. 2.

The apparatus 10 also includes an inert gas intake line 18 such as for nitrogen, which extends from a top portion of the cavity 14 to the bottom portion thereof. The nitrogen intake line has an inlet 20 and an outlet 22. In other embodiments, the nitrogen intake line 18 may have a plurality of outlets along the length dispersed within the molten silver 16. A lower passageway 24 is arranged at the bottom of the cavity 14 and is also filled with molten silver 16. Both the cavity 14 and the passageway 24 may have a circular cross-section as shown in FIG. 3. However, the particular geometric shape of the cavity 14 and the passageway 24 is not important. An opening 26 is arranged in the lower passageway 24 so that the molten silver 16 can flow therefrom while performing the method of manufacturing silver anodes in accordance with the present invention.

Figure 2:
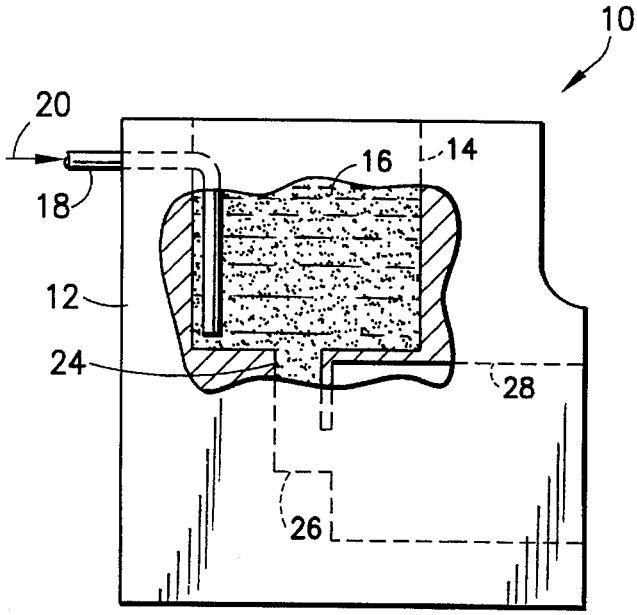
FIG. 2 is a partial cross-sectional view of a portion of the apparatus shown in FIG. 1.
Figure 4:
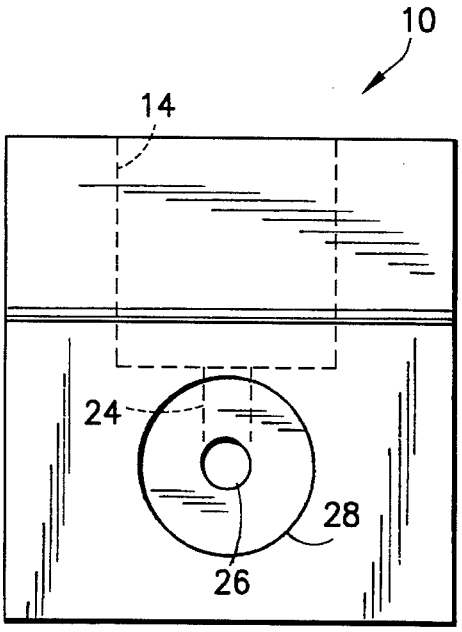
FIG. 4 is a front view of the portion of the apparatus shown in FIG. 2.
Figure 5:
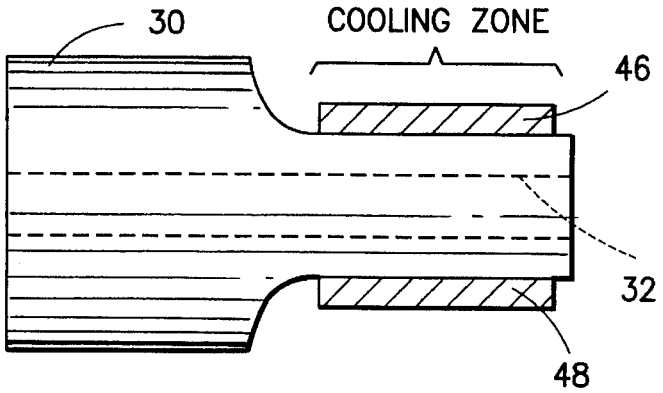
FIG. 5 is a partial cross-sectional view of a carrier of the apparatus shown in FIG. 1.
Figure 6:
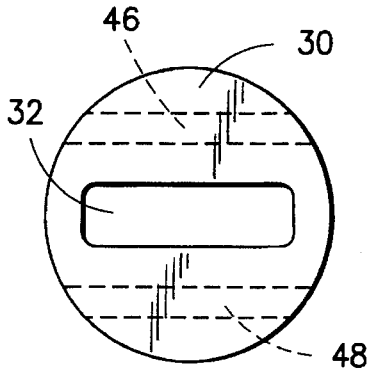
FIG. 6 is a front view of the carrier shown in FIG. 5.
Figure 7:
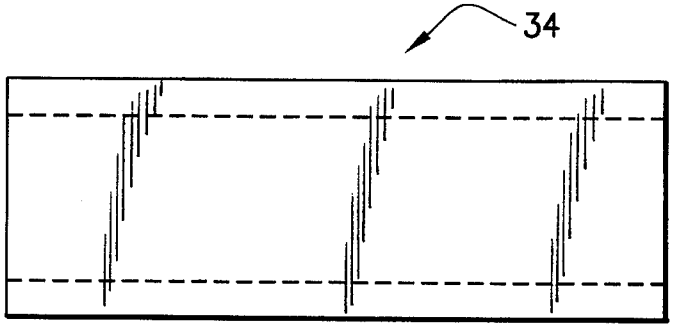
FIG. 7 is a top view of a die which may be used as part of the apparatus shown in FIG. 1 to carry out the method of the present invention.

As shown in FIGS. 1 and 2, crucible 10 includes an opening 28 that is sized to receive a carrier 30 shown in FIGS. 1 and 5. The carrier 30 includes a passageway 32 which is aligned with the opening 26 through which the molten metal 16 will be permitted to flow. As shown in FIG. 4, the opening 26 may be centrally arranged within the carrier opening 28. Passageway 32 within the carrier 30 can best be appreciated with reference to FIGS. 1, 5 and 6.

Figure 8:
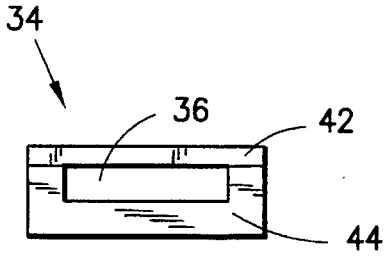
FIG. 8 is a front view of the die shown in FIG. 7.

A die 34 is sized to be inserted and retained within the passageway 32 of the carrier 30. The die 34 includes a channel 36 which will serve as a flow path for the molten silver 16. The channel 36 has a generally rectangular cross-section and is so shaped and sized to provide the resulting silver anode in final form to eliminate the need of further shaping or sizing. The channel 36 is best shown in FIGS. 1 and 8. The exact dimensions of the die 34 and the channel 36 may vary in alternate embodiments. In one embodiment the die length is between about eight inches and twenty-four inches.

The channel 36 includes an inlet 38 and an outlet 40 which will be discussed in more detail below. The size of the outlet may exceed the size of the inlet by 0.0001 inch along both the x and z axes (i.e., along the horizontal and vertical axes). This results in the channel tapering along its length.

This feature is known as the relief size and provides room for the molten silver to expand during the cooling and solidification process as it is transported through the channel 36.

As illustrated in FIG. 8, the die 34 may include a top half 42 and a bottom half 44 that are machined together. Alternately, the die may be manufactured from a single mold, or may have more than two components secured together.

With the basic structure of the aforementioned apparatus in mind, the method of manufacturing fully annealed silver anodes can be more fully appreciated. When the silver is initially placed within the cavity 14, it is typically in a solid state. The silver will be heated within the cavity 14 of the crucible 12 to a temperature above its melting point (i.e., 1750° F.) so that it obtains a molten state. Preferably, the temperature of the molten silver 16 will be between about 1950° F.–2250° F. when it is within the crucible 12.

The molten silver 16 is purged by an inert gas, such as nitrogen, within the cavity 14. In this regard, nitrogen is forced to flow through the nitrogen line 18 into the cavity 14 through outlet 22. Purging the molten silver 16 in this manner will remove substantially all of the oxygen therefrom. As discussed above, it is desirable to remove the oxygen from the heated silver to prevent the undesirable formation of oxides. Thus, the use of the nitrogen purge creates an oxygen-free environment for the molten silver 16. Since no oxides are permitted to form, the resulting silver anodes dissolve easily during electroplating and will not form black sludge in the plating tank. The molten silver 16 within the crucible 14 is also maintained under a nitrogen blanket. The resulting anodes of the present method preferably contain less than about 10 parts per million (ppm) of oxygen. This is particularly impressive when compared to other commercially available silver anodes. For example, most of the known silver anodes that are available in the commercial marketplace usually contain between about 50–1200 ppm oxygen.

After the molten silver 16 has been sufficiently purged with nitrogen within the crucible 14, gravity causes it to flow through opening 26 in the lower passageway 24 and into the inlet 38 of the die channel 36. The temperature of the molten silver 16 at this location may be between about 1800° F. and 2100° F.

A removable starter bar 52, having the same shape as the channel 36, is extended into the channel of the die 34 until it reaches the vicinity of the inlet 38. The starter bar 52 is made of a metal having a higher melting point than silver so that it will not melt when exposed to the molten silver. As the molten silver 16 begins to flow through the channel 36, it encounters the cool end of the starter bar 52. As the molten silver approaches its solidification temperature, the silver adheres to the starter bar 52. The other end of the starter bar 52 extends out of the outlet 40 of the channel 36 away from the crucible 12. The other end of the starter bar is retained within a pinch roller assembly 54 that is adapted to continuously pull the starter bar at a controlled rate out of the channel 36 as the molten silver 16 continues to flow through the channel 36.

The cooling plates 46 and 48 are arranged on the top and bottom of the conductive carrier 30 which acts as a housing for the die 34. The cooling plates may be cooled by various means, and in accordance with one embodiment, they are cooled by water that continuously flows through the cooling plates 46 and 48. The continuous flow of water through the cooling plates 46 and 48 acts as a heat dissipater and thus, removes heat from the die 34 and the molten silver 16 as it flows through the channel 36.

The starter bar 52 in one embodiment is pulled by the pinch roller assembly 54 at a rate of between about four inches and six inches per minute. As the molten silver 16 flows toward the cooling plates 46 and 48, it continues to cool so that it solidifies on the starter bar 52. Since the silver 16 adheres upon solidification to the starter bar, it is transported through the channel 36 at the same rate. The temperature of the molten silver 16 at a distance of approximately six inches from the outlet 40 is between 1650° F. and 2050° F. When the silver reaches about four inches from the outlet 40, it is at a temperature of between 300° F. and 900° F.

As the starter bar 52 continues to be pulled away from the outlet 40 by the pinch roller assembly 54, the solidified silver 50 is pulled out of the outlet 40. Eventually, the solidified silver 50 is pulled into the pinch roller assembly 54.

As discussed above, the outlet 40 is larger than the inlet 38 by at least 0.0001 inch in both the x and z axes. This size differential will provide a relief to the molten silver 16 as it solidifies within the channel 36. Thus, the relief serves the purpose of preventing the silver from wedging within the channel 36 of the die 34 due to its expansion.

The above-described process of manufacturing silver anodes is considered a continuous casting process. In performing the continuous casting process, it is important to maintain control over the cooling profile of the silver as it leaves the cavity 16 and flows through the channel 36 until it is pulled out of the outlet 40 thereof. By controlling the cooling profile in accordance with the present method, a fully annealed silver anode is produced without requiring a subsequent annealing step.

Annealing of silver is performed by heating the silver to a predetermined temperature, and maintaining the silver at this temperature for a predetermined period of time. The silver must then be cooled to approximately room temperature. By selecting the appropriate values for heating and cooling of the silver, a fully annealed silver anode may be obtained.

Fully annealed silver has a rockwell C hardness of about 22 C or less. The silver undergoes several changes as it cools from its molten state to a solid state in a manner sufficient to produce a fully annealed product. In particular, crystallization of the silver particles will occur in a random manner so that the degree of strain within the fully annealed silver anode is particularly low. Additionally, the formation of a crystal lattice structure of fully annealed silver results in relatively small grain boundaries when compared to grain boundaries of non-annealed silver.

Various factors may be modified in order to obtain the fully annealed silver anode in accordance with the present invention. These factors include, for example, (a) the initial temperature of the molten silver in the crucible, (b) the flow rate of the silver through the die 34, (c) the contact area of the cooling plates 46 and 48 on the conductive carrier 30, (d) the temperature of the cooling plates 46 and 48, (e) the temperature of the ambient air, (f) the thermal conductivity of the material of which the die 34 and the carrier 30 is made and (g) the length of the channel 36 through the die 34.

In order to assure that the cooling gradient remains relatively constant, the temperature of the die 34 should be monitored from time to time. If the temperature of the cooling plates 46 and 48 is relatively low, the flow rate of the silver through the channel 36 can be relatively fast. On the other hand, as the temperature of the coolant within the cooling plates 46 and 48 increases, the flow rate of the silver through the channel 36 should be decreased.

Figure 10:
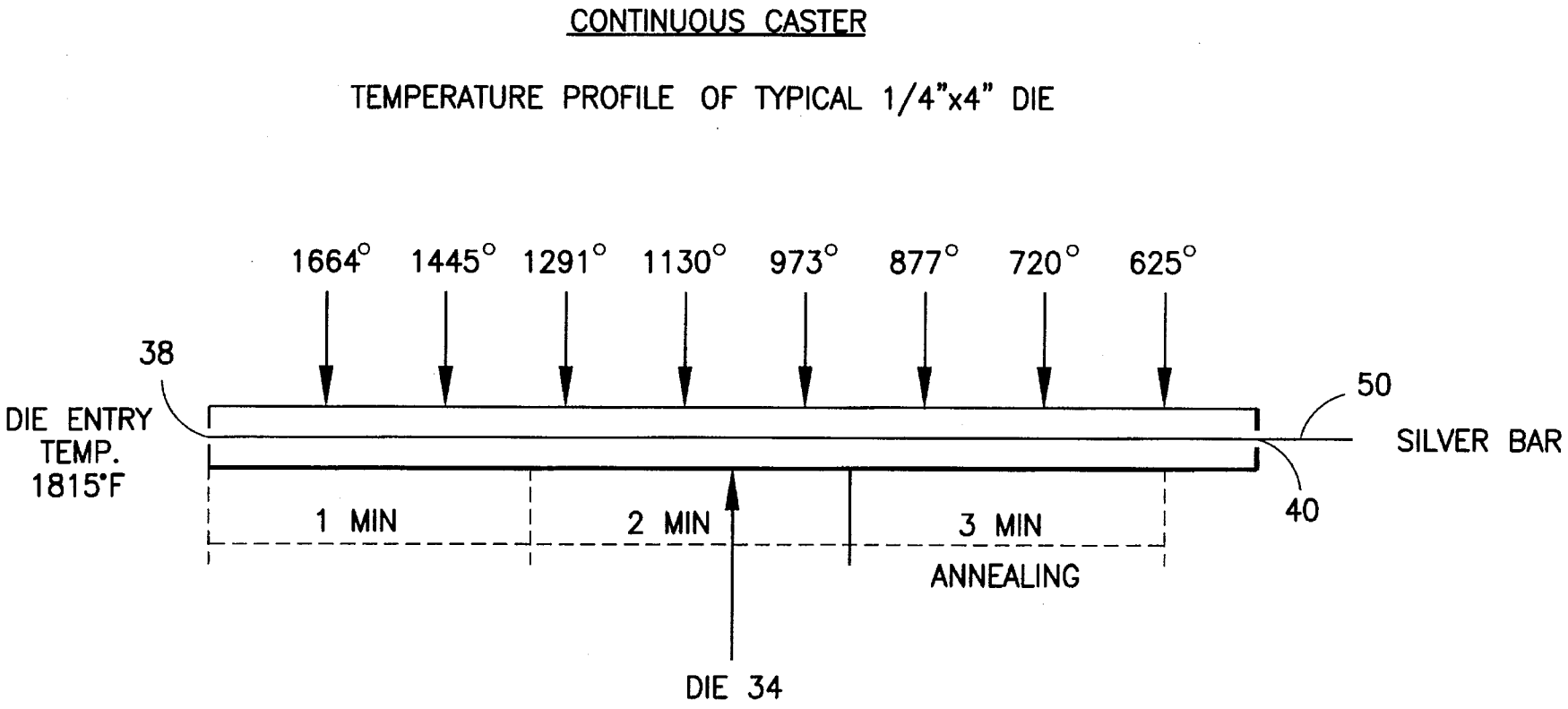
FIG. 10 is a graphical depiction illustrating the approximate temperatures of silver at various locations as it flows through the die shown in FIGS. 1, 7 and 8.

FIG. 10 illustrates one preferred example of the temperature versus time relationship for silver as it is transported through the channel 36 of the die 34 in accordance with the present method. In this example, the temperature of the molten silver is about 1815° F. as it enters the die 34. After it enters the channel of the die, the molten silver quickly cools below its solidification temperature (i.e., about 1750° F.). As the roller assembly 54 continues to pull the silver through the channel of the die at a rate of between about four and six inches per minute, the solidified silver continues to cool at a rate which can be graphically depicted as having a slope substantially in accordance with a linear ramp (see FIG. 10). In particular, the silver cools from its initial entry temperature of about 1815° F. to below 970° F. in less than the first two minutes in the die 34. Annealing does not begin until the temperature of the solidified silver falls below about 800° F. At this time, the silver has been within the die between two and three minutes.

Figure 11:
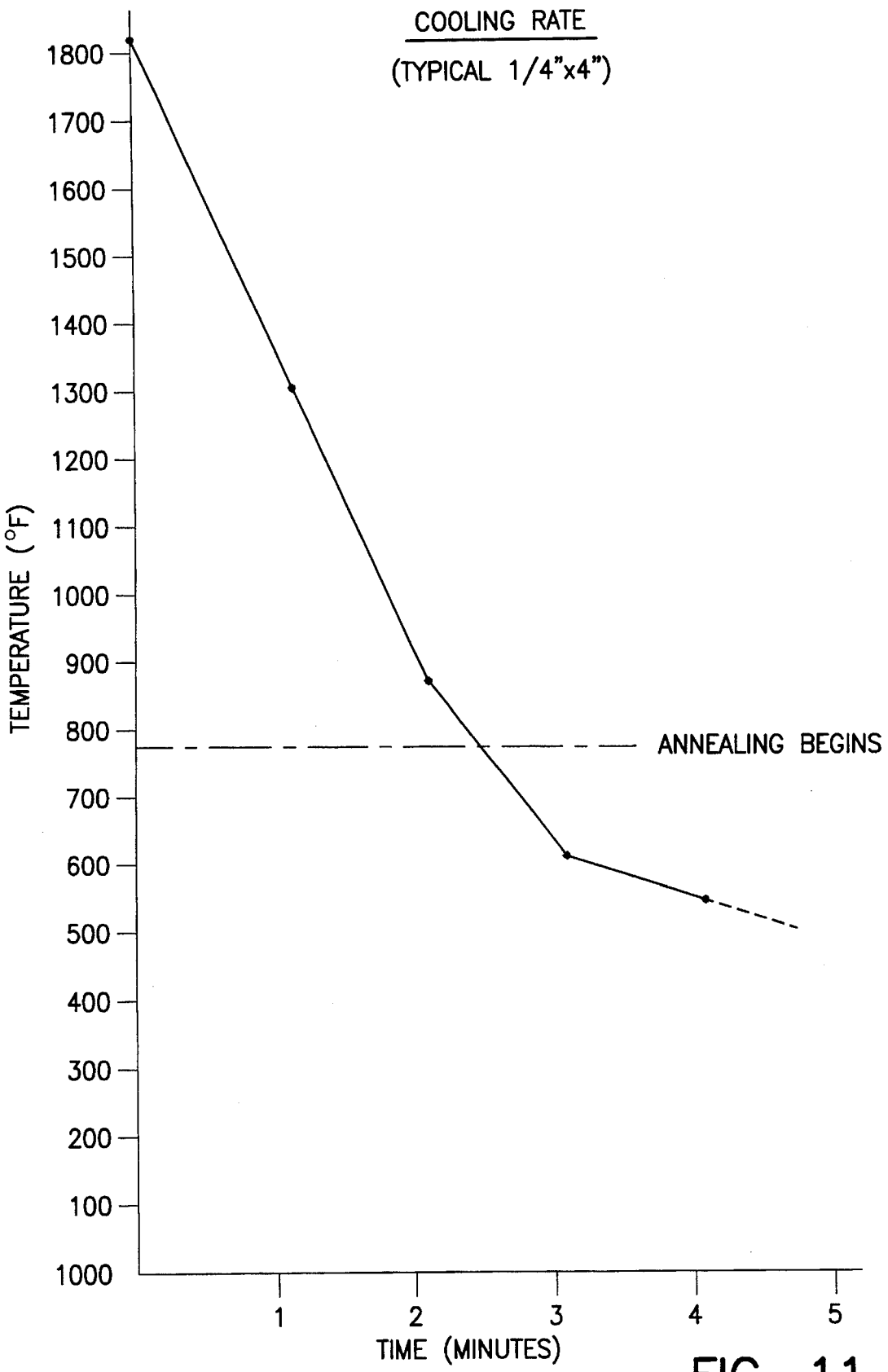
FIG. 11 is a graphical depiction illustrating the temperature versus time cooling profile of silver in accordance with one embodiment of the present invention.

FIG. 11 illustrates the cooling profile, based on the values shown in FIG. 10, in the form of a temperature v. time curve, obtained in accordance with the above-described method. When such a cooling curve is obtained during the continuous casting process of the present invention, the resulting silver anode will be fully annealed. Such a fully annealed silver anode has a random crystal formation. Additionally, the crystals are relatively large and the grain boundaries are therefore, relatively small. The resulting fully annealed silver anodes can be manufactured at particularly low costs and have many advantages over known commercially available silver anodes. These advantages have been discussed briefly above and include decreasing of the flaking of silver within the plating tank so that virtually no flaking occurs, tremendous reduction in sludge formation in the plating tank, increased sites for electrolytic dissolution which results in faster dissolution of silver ions and a great increase in efficiency, reduction of internal stress within the silver anode, and a high degree of consistency and uniformity of silver plating.

Figure 9:
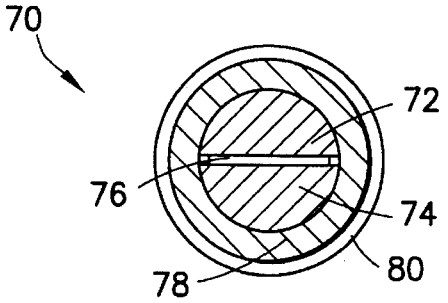
FIG. 9 is an alternate embodiment of a portion of an assembly for use in connection with the apparatus shown in FIG. 2.

As can be appreciated, various apparatuses can be utilized for performing the method of manufacturing fully annealed silver anodes in accordance with the present invention. One alternate embodiment of a die, a carrier and cooling means is shown in FIG. 9. In this embodiment, each of these elements are depicted as an assembly generally designated 70. The die has a cylindrical shape and includes a top half 72 and a bottom half 74 which may be machined together, or which may be retained in contact by a carrier 78 which functions as a sleeve surrounding both the top half 72 and the bottom half 74 of the die. As with the other embodiment, the channel 76 will again extend along the entire length of the die.

The cooling means of this embodiment is shown in FIG. 9 as a water jacket 80 which entirely surrounds the conductive carrier 78 so that heat may be dissipated therefrom. The cooling jacket 80 serves the same purpose as the cooling plates 46 and 48 in the preferred embodiment. The only difference is that the cooling jacket 80 is arranged to extend around the entire circumference of the carrier 78 as opposed to being secured to the top and bottom portions only.

The slope of the temperature v. time curve shown in FIG. 10 is indicative of a cooling gradient that can be followed to assure that a fully annealed silver anode will be produced in accordance with the continuous casting process of the present invention. In a specific example of manufacturing a fully annealed silver anode to obtain the cooling profile as shown in FIGS. 10 and 11, a die having a length of approximately fourteen inches was used. The channel of the die had a cross-sectional area of about two square inches. The die was made of 20/20 Stackpole carbon. The carrier was made of similar material. The crucible was made of 20/20 Stackpole carbon. The cooling plates had a contact area of forty-four square inches on both the top and bottom of the carrier 30. The coolant fluid was water having an initial flow temperature of approximately 45° F. The molten silver 16 had a temperature of approximately 2000° F. ±50° F. when it was retained within the cavity 14 of the crucible 12. The flow rate of the silver generated by the pinch roller assembly 54 was about three–five inches per minute.

While the foregoing description and figures are directed toward the preferred methods, and a product obtained by using such methods, in accordance with the present invention, it should be appreciated that numerous modifications can be made to each of the steps of the present method. Indeed, such modifications are encouraged to be made in the order in which the steps are conducted and the specific apparatus used to perform such steps without departing from the spirit and scope of the present methods. Thus, the foregoing description of the preferred methods should be taken by way of illustration rather than by way of limitation with respect to the present invention, which is defined by the claims set forth below.

What is claimed is:

1. A method of manufacturing metal anodes having a fully annealed state, said method comprising the steps of:

supplying metal for forming an anode therefrom;

heating said metal to a molten state;

flowing said molten metal at a selected flow rate through a die having a channel of selected length extending between an inlet and an outlet;

cooling said molten metal flowing through said channel at a selected cooling rate to a solid state therein; and annealing the metal within the die, as the metal proceeds through said channel, by controlling said selected flow rate and said selected cooling rate of said molten metal such that a metal anode having a fully annealed state is delivered at said outlet.

2. The method of claim 1 wherein said step of cooling said molten metal comprises initiating said cooling within a predetermined cooling zone, said predetermined cooling zone extending over less than about 50 percent of the predetermined length of said channel.

3. The method of claim 2 wherein said channel includes a first half extending from said inlet and a second half extending from said outlet, and said cooling zone is located within said second half.

4. The method of claim 3 wherein said step of cooling said molten metal further comprises flowing cooling fluid through a plurality of cooling plates arranged adjacent said channel within said second half.

5. The method of claim 3 wherein said cooling zone extends over approximately one third of the length of said channel.

6. The method of claim 1 wherein said metal comprises at least 99 percent silver, and said molten state is in the range of about 1900° F. to 2300° F.

7. The method of claim 6 wherein said molten state is in the range of about 2000° F. to 2250° F.

8. The method of claim 7 wherein said selected flow rate of said metal through said channel is between about two inches per minute and ten inches per minute.

9. The method of claim 8 wherein said selected flow rate of said metal through said channel is between about four inches per minute and six inches per minute.

10. The method of claim 1 wherein said outlet and said inlet each include horizontal and vertical axes, and said horizontal and vertical axes of said outlet each at least about 0.0001 inch longer than said horizontal and vertical axes of said inlet, whereby said outlet accommodates the expansion in the cross-sectional area of said molten metal along said horizontal and vertical axes as the molten metal flows between said inlet and said outlet.

11. The method of claim 1 wherein said selected flow rate and said cooling rate of said molten metal are selected such that said solid state of said molten metal at said outlet of said channel is in the range of about 300° F. to 425° F.

12. The method of claim 1 wherein said step of heating said metal to a molten state occurs within a crucible, said crucible having a passageway in communication with said inlet of said channel so that said molten metal can flow from said crucible through said inlet and into said channel, said method further comprising the step of purging oxygen from said molten metal within said crucible with an inert gas by flowing said inert gas through said molten metal from a lower portion of said crucible to an upper portion thereof.

13. The method of claim 1 wherein said length of said channel is between about ten inches and twenty-four inches.

14. The method of claim 1 wherein said length of said channel is between about twelve inches and seventeen inches.

15. A method of manufacturing fully annealed silver anodes comprising the steps of:

supplying metal comprising at least 99 percent silver to a crucible;

heating said metal within said crucible to a molten state at a temperature between about 1800° F. and 2400° F.;

arranging a channel having a channel of selected length adjacent said crucible, said channel having an inlet and an outlet and arranged in fluid communication with said molten metal within said crucible;

flowing said molten metal from said crucible through said channel at a selected flow rate of between about two inches per minute and ten inches per minute;

cooling said molten metal flowing through said channel at a selected cooling rate to a solid state therein, said step of cooling said molten metal including initiating said cooling within a cooling zone, said cooling zone extending over less than 50 percent of the length of said channel; and annealing the metal within the channel, as the metal proceeds through said channel, by controlling said selected flow rate and said selected cooling rate of said molten metal within said cooling zone such that a fully annealed silver anode is delivered at said outlet.

16. A fully annealed metal anode manufactured by a method comprising the steps of:

supplying metal for forming an anode therefrom;

heating said metal to a molten state;

flowing said molten metal at a selected flow rate through a channel having a channel of selected length extending between an inlet and an outlet;

cooling said molten metal flowing through said channel at a selected cooling rate to a solid state therein; and annealing the metal within the channel, as the metal proceeds through said channel, by controlling said selected flow rate and said selected cooling rate of said molten metal such that a metal anode having a fully annealed state is delivered at said outlet.

17. The fully annealed metal anode of claim 16 wherein said step of cooling said molten metal comprises initiating said cooling within a cooling zone, said zone extending over less than about 50 percent of the length of said channel.

18. The fully annealed metal anode of claim 17 wherein said channel includes a first half extending from said inlet and a second half extending from said outlet, and said cooling zone is located within said second half.

19. The fully annealed metal anode of claim 18 wherein said Step of cooling said molten metal further comprises flowing cooling fluid through a plurality of cooling plates arranged adjacent said channel within said second half.

20. The fully annealed metal anode of claim 16 wherein said metal comprises at least 99 percent silver, and said molten state is in the range of about 1900° F. to 2300° F.

21. The fully annealed metal anode of claim 20 wherein said flow rate of said metal through said channel is between about two inches per minute and ten inches per minute.

22. The fully annealed metal anode of claim 21 wherein said flow rate of said metal through said channel is between about four inches per minute and six inches per minute.

23. The fully annealed metal anode of claim 16 wherein said outlet and said inlet each include horizontal and vertical axes, and said horizontal and vertical axes of said outlet each is at least about 0.0001 inch longer than said horizontal and vertical axes of said inlet, whereby said outlet accommodates expansion in the cross-sectional area of said molten metal along said horizontal and vertical axes as said molten metal flows between said inlet and said outlet.

24. The fully annealed metal anode of claim 16 wherein said flow rate and said cooling rate of said molten metal are controlled such that said solid state of said molten metal at said outlet is in the range of about 300° F. to 425° F.

25. The fully annealed metal anode of claim 24 wherein said step of cooling said molten metal comprises initiating said cooling within a cooling zone extending over approximately one third of the length of said channel.

26. A fully annealed silver anode manufactured by a method comprising the steps of:

supplying metal comprising at least 99 percent silver to a crucible;

heating said metal within said crucible to a molten state at a temperature between about 1800° F. and 2400° F.;

arranging a channel having a channel of selected length adjacent said crucible, said channel having an inlet and an outlet and arranged in fluid communication with said molten metal within the crucible;

flowing said molten metal from said crucible through said channel at a selected flow rate of between about two inches per minute and ten inches per minute;

cooling said molten metal flowing through said channel at a selected cooling rate to a solid state therein, said step of cooling said molten metal including initiating said cooling within a cooling zone extending over less than 50 percent of the length of said channel; and annealing the metal within the channel, as the metal proceeds through said channel, by controlling said selected flow rate and said selected cooling rate of said molten metal within said cooling zone such that a fully annealed silver anode is delivered at said outlet.

* * * * *